US009976275B2

(12) United States Patent
Thurner et al.

(10) Patent No.: US 9,976,275 B2
(45) Date of Patent: May 22, 2018

(54) METHOD AND APPARATUS FOR DRIVING SCREWABLE FOUNDATIONS INTO THE GROUND

(71) Applicant: Krinner Innovation GmbH, Straβkirchen (DE)

(72) Inventors: Günther Thurner, Straβkirchen (DE); Martin Thurner, Straβkirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 0 days. days.

(21) Appl. No.: 15/121,487

(22) PCT Filed: Dec. 30, 2014

(86) PCT No.: PCT/EP2014/079450

§ 371 (c)(1),
(2) Date: Aug. 25, 2016

(87) PCT Pub. No.: WO2015/128048

PCT Pub. Date: Sep. 3, 2015

(65) Prior Publication Data

US 2016/0362864 A1 Dec. 15, 2016

(30) Foreign Application Priority Data

Feb. 28, 2014 (DE) ..... 10 2014 002 986

(51) Int. Cl.
*E02D 7/26* (2006.01)
*E02D 5/28* (2006.01)
(Continued)

(52) U.S. Cl.
CPC ..... *E02D 7/26* (2013.01); *E02D 5/28* (2013.01); *E02D 5/56* (2013.01); *E02D 5/60* (2013.01); *E02D 7/06* (2013.01); *E02D 7/22* (2013.01)

(58) Field of Classification Search
CPC combination set(s) only.
See application file for complete search history.

(56) References Cited

U.S. PATENT DOCUMENTS 3,404,740 A * 10/1968 Hoppe ..... E02D 3/106 173/111
3,777,825 A * 12/1973 Gullich ..... B25D 16/00 173/109

(Continued)

FOREIGN PATENT DOCUMENTS

DE 3617025 A1 11/1987
DE 3911467 C2 1/1992

OTHER PUBLICATIONS

Thyssenkrupp, KRUPP Drifter HB60 product manual.*
International Search Report for application No. PCT/EP2014/079450, dated Mar. 31, 2015.

*Primary Examiner* — Kyle Armstrong
(74) *Attorney, Agent, or Firm* — Marshall, Gerstein & Borun LLP

(57) ABSTRACT

Disclosed is a method for driving a screwable foundation, which comprises a thread-type external helix that has a pitch on the outer contour thereof, into the ground. In said method, a striking force is applied to the screwable foundation in the driving direction in alternation with or at least temporarily simultaneously with a torque when the screwable foundation is driven into the ground.

8 Claims, 7 Drawing Sheets

(51) Int. Cl.

| | |
|---|---|
| ***E02D 5/56*** | (2006.01) |
| ***E02D 5/60*** | (2006.01) |
| ***E02D 7/06*** | (2006.01) |
| ***E02D 7/22*** | (2006.01) |

(56) References Cited

U.S. PATENT DOCUMENTS

| | | | | | |
|---|---|---|---|---|---|
| 3,869,003 | A * | 3/1975 | Yamada | E02D 7/26 | 173/156 |
| 4,061,197 | A * | 12/1977 | Skidmore, Jr. | E21B 4/14 | 175/101 |
| 4,553,443 | A * | 11/1985 | Rossfelder | B06B 1/161 | 173/147 |
| 5,010,965 | A | 4/1991 | Schmelzer | | |
| 8,484,909 | B2 * | 7/2013 | Thurner | E04H 12/2223 | 405/252.1 |
| 2003/0221870 | A1 * | 12/2003 | Johnson, Jr. | E21B 7/20 | 175/71 |
| 2008/0044236 | A1 * | 2/2008 | Lloyd | E02D 7/16 | 405/232 |

* cited by examiner

METHOD AND APPARATUS FOR DRIVING SCREWABLE FOUNDATIONS INTO THE GROUND

CROSS-REFERENCE TO RELATED APPLICATIONS

This is the United States national phase of International Patent Application No. PCT/EP/2014/079450, filed Dec. 30, 2014, which claims priority to German Application No. 10 2014 002 986.7, filed Feb. 28, 2014. Each of the foregoing is incorporated herein by reference in the entirety.

FIELD OF THE DISCLOSURE

The invention relates to a method and an apparatus for driving screwable foundations into the ground, in particular into ground of varying soil conditions.

BACKGROUND

Screwable foundations are inserted in various ways and are also driven into the ground with screw-in tools of mechanical type. In order to be nevertheless able to drive the screwable foundations into the ground reliably for varying soil conditions, i.e. in particular when stones are situated in the screw-in path of the screwable foundation, the corresponding screwable foundations have been equipped with hardened tips or with chisel-like additional tools, which are guided in the interior of the screwable foundation and serve for the destruction of the stone, as it were, at the leading edge during the driving of the screwable foundation.

In contrast, strike-in sleeves are known, which are merely struck or respectively driven into the ground by a striking tool. Whereas in the case of strike-in sleeves only one strike-in apparatus is present, i.e. a screwing-in prohibits itself, because the strike-in sleeves have webs, constructed in longitudinal or respectively strike-in direction, to secure against rotation, the screwable foundations have thread-like webs arranged on their outer contour, so that they can be screwed in level into the ground. Screwable foundations are therefore not suitable for striking in.

During screwing in, for the purpose of a reliable anchoring, the screw-in sleeve, i.e. the screwable foundation with the webs, is to rotate into the ground, but is not to loosen it substantially. Depending on the soil conditions, therefore different web heights have been developed. In order to be able to also reliably drive screwable foundations into soils which are very hard or which have stones as obstacles for the driving of the screwable foundations, screwable foundations with open tips have been developed, in which an additional percussion bit is introduced into the screwable foundations, complicating the entire driving system, so that during the screwing in by means of a striking movement onto the bit, stones in the soil ahead of the screwable foundation can be broken or disintegrated if applicable. The striking movement of the bit takes place here independently of the rotary movement of the screwable foundation.

Owing to the fact that screwable foundations are screwed into the ground and, in order to guarantee a reliable anchoring, are not to be loosened during the screwing-in process, it prohibits itself to use rotary tools and striking tools together for the driving of screwable foundations.

Such combinations are only known for pile-driving devices, which are also designated as drill hammers. These devices serve for the production of tubular earth bores and are similar in basic structure to those such as are used for percussion drill devices for example for the drilling of hard concrete and are generally known (see DE 3911467 C2).

The fundamental sequence in the use of such drill hammers would mean that firstly pre-drilling would be carried out, then a drill would have to be removed from the produced borehole in order to subsequently be able to screw in a foundation, if applicable. The pre-drilling and production of a borehole for the driving of a screwable foundation is, however, disadvantageous especially also because if applicable it can then not be ensured that the screwable foundation is reliably anchored, and because, moreover, a pre-drilled hole has in fact been produced for the screwable foundation, but it is not to be ruled out that a stony soil condition offers considerable resistance to the penetration of the screw helixes of the screwable foundation, so that on screwing in even with a pre-drilled hole if applicable the screwable foundation which is to be driven could be damaged or even destroyed.

In addition, from DE 36 17 025 A1 for prefabricated concrete piles it is known to drive these into the ground with the exerting of an axial speed of advance and simultaneous rotation about their longitudinal axis. In an embodiment, the speed of advance and the rotational movement are synchronized according to the pitch of the helical rib arrangement. Firstly, here, the rotational speed is regulated as a function of the actual distance covered, until some turns of the rib have caught in the subsoil and the axial force necessary for the displacing of the ground can be provided by pure further rotation of the concrete pile owing to the support of the rib. Then primarily the rotational speed is set according to the desired speed of advance.

GENERAL DESCRIPTION

The object of the present invention consists in providing a method and an apparatus by means of which screwable foundations can be reliably driven into soils of different conditions and can nevertheless be anchored reliably.

In the method according to the invention, depending on the soil conditions, a torque and a striking force onto the screwable foundation, aligned in the driving direction of the screwable foundation, are used in alternation in succession or at least temporarily simultaneously. The screwable foundation has on its outer contour a thread-type external helix with a defined pitch. When the screwable foundation is now screwed into the ground, i.e. not bored in, then at a given rotation rate according to the pitch the penetration distance over time or respectively the speed of advance is established theoretically.

Through the combination of screwing in and striking in of screwable foundations, it has been surprisingly found that a secure fastening of screwable foundations can be ensured in particular in hard and/or stony soils, although it may basically be expected that through the use of striking forces on screwing in of screwable foundations the hold in the ground is reduced, because the borehole is widened in particular in the region of the screw helix. This applies in particular in the use of conventional drill hammers, which are used for the boring of cylindrical boreholes. Known hammer drill drives have a maximum torque of 750 to 3000 Nm and a strike power of up to 20 KW. It becomes apparent herefrom that the main propulsion results from the striking force, and the torque is used predominantly for moving the bit and for the evacuation of the excavated material.

In order to guarantee a secure driving and fastening of screwable foundations, the ratio of torque and strike power is altered in favor of the torque. In particular, the maximum torque is increased compared to the previously mentioned conventional hammer drill heads, and the strike power is kept constant or even reduced. An example embodiment lies at a torque of 5 to 10 kNm and a strike power of approximately 5 kW, so that a ratio of approximately 1 to 2:1 exists. Through the engaging of the strike, for example on impinging on a stone, it is ensured that the obstacle is overcome without loosening the surrounding ground to such an extent that a secure anchoring of the screwable foundation is no longer guaranteed. It is also prevented that the screwable foundation is rotated without, in so doing, generating appreciable propulsion, and the screw helix churns up and loosens the surrounding soil, as takes place in the case of a screwing in without striking on impinging onto an obstacle.

The application to the screwable foundation with a torque and with a striking force takes place here preferably on the basis of a rotation rate measurement and a longitudinal movement measurement of the screwable foundation. If, owing to resistances or uneven soil conditions, the actual penetration distance does not correspond to the theoretical value for the penetration distance, then a slip value not equal to 1 is present. The slip or respectively the slip value is defined here as follows: $s=(n\cdot p)\cdot v^{-1}$, i.e. rotation rate times pitch through speed of advance. Therefore a (current) slip value is determined preferably on the basis of a rotation rate measurement and a longitudinal movement measurement (advance measurement) of the screwable foundation and of the pitch. The slip value is kept within predefined limits by altering the rotation rate and switching the striking force on or respectively off. Preferably, the limits of the slip value are defined such that a certain deviation from the theoretically covered penetration distance is permitted, i.e. limits are defined as a function of the theoretically covered penetration distance. The rotation rate and the striking force are regulated with respect to one another so that on exceeding the amount of this slip value, i.e. a limit of the slip value, the striking force is switched on or off, wherein the regulating takes place so that the amount of the slip value after the switching on or respectively switching off is adhered to again. This means that the rotation rate and the striking force are regulated with respect to one another so that always the predetermined limits of the slip value are not exceeded. It can namely only then be ensured that on the one hand a good penetration into the ground is guaranteed, i.e. that, where applicable, resistances existing through stones are overcome with a corresponding slower penetration speed, but that in so doing the secure anchoring of the screwable foundation with its external helixes in the ground is not overridden.

If, according to a preferred embodiment, the actual penetration distance is reduced compared to a theoretical penetration distance related to the current rotation rate, then the striking force is switched on and the rotation rate is adapted on the basis of the longitudinal movement and the pitch. This is the case, for example, when the screwable foundation encounters a hard area of ground, such as e.g. a stone, during screwing in.

When accordingly thereafter the obstacle in the ground is overcome, i.e. the stone is, for example, penetrated, then, as it were, the reduced longitudinal movement no longer exists, so that a normal longitudinal movement can occur, which initially has the effect of an increased rotation rate. When these circumstances are detected, the striking force is then switched off. Therefore, through the present method, it is preferably even possible to guarantee a stone detection in the ground.

According to a preferred embodiment, the theoretical longitudinal distance which is covered is determined as a whole such as e.g. by integral formation and compared with the actual longitudinal distance which has been covered by means of the screwable foundation on screwing in. If this actual longitudinal distance is now reduced compared to the theoretically covered longitudinal distance, wherein the theoretically covered longitudinal distance is determined from pitch and rotations, then the striking force is switched on and the rotation rate is reduced to the extent that the reduced longitudinal distance is adapted accordingly in the direction of the longitudinal distance which is to be expected. On reaching a predetermined approximate value to the expected, i.e. theoretical longitudinal distance, the striking force is switched off again.

According to a further preferred embodiment, the torque exerted on the screwable foundation is limited or is reduced. For example, a maximum torque is predetermined by the drive or is adjusted to the machine as a function of the soil conditions, the type of screwable foundation and/or further driving- or respectively limiting conditions. Preferably, accordingly, the measured current torque is compared with a predetermined maximum torque during penetration. Preferably, on reaching the predetermined maximum torque, the rotation rate is reduced to such an extent, and simultaneously the striking mechanism is switched on, that the predetermined maximum torque is not exceeded. Further preferably, after limiting or reducing the torque, the striking force is exerted onto the screwable foundation until, on a renewed slight torque, i.e. a renewed accelerating of the device, a propulsion in the driving direction is present again.

The striking force is preferably switched on in the case of a decrease of the rotation rate by a predefined amount. During the driving of the screwable foundation, in the case of continuously constant soil conditions, a substantially constant torque is required of the screwing-in tool. At all events, the torque increases continuously over the screwing-in depth owing to increasing friction. When the screwable foundation, and in particular the tip of the screwable foundation, impinges onto a layer of hard subsoil or a stone or respectively rock, then the required torque increases abruptly. If this torque increase is limited by the maximum torque of the drive, the rotation rate decreases. With such a rotation rate decrease, the striking force then is preferably switched on. The rotation rate decrease is able to be defined here via a (negative) pitch or a rotation rate difference as a threshold value. On exceeding the threshold value, the striking force is preferably switched on automatically. Alternatively or additionally, the exceeding of the threshold value is also able to be displayed via an indication device, for example in the form of a lamp or a display.

Alternatively, the impinging of the screwable foundation onto a stone, a rock or suchlike is also able to be recognized by the abrupt increase of the torque. Therefore, such a behavior of the torque is able to be detected and able to be used as a switch-on condition for the striking force. Likewise, a torque difference or an increase of the torque curve are also able to be defined as threshold value for detection.

The maximum torque and/or the threshold value for the switch-on condition are preferably set here as a function of the soil conditions and/or of the screwable foundation which is to be screwed in.

This embodiment is also possible entirely independently, i.e. without corresponding slip values being necessary as a basis for a regulation of the switching on or respectively switching off of the torque or respectively of the striking force. The regulation is carried out on the basis of the maximum torque. Always, therefore, on reaching the maximum torque, the latter is reduced or switched off and the striking force is switched on, to which, after a corresponding penetration distance, the switching on of the torque can again follow. In such a case, a multiple changeover between switching on and switching off of torque and/or striking force is conceivable, so that through the balanced combination of the switching on or respectively switching off of torque and striking force, an optimum screwing in of the screwable foundation is guaranteed, with simultaneous ensuring of a reliable anchoring.

Preferably, the striking force is switched off here on reaching the nominal rotation rate and on decrease of the torque by a predefined value.

In addition to a percussion hammer, it is possible furthermore that the striking force is exerted by high-frequency oscillations. The high-frequency oscillations can preferably be high-frequency or ultra-high-frequency acoustic oscillations.

According to a second aspect of the invention, an apparatus is provided for driving screwable foundations into the ground, by means of which a sleeve body with external helix present on its outer sides with a thread-like pitch is introduced. This apparatus implements the previously described method according to the invention. This apparatus has a rotation apparatus for the screwing in of the screwable foundation, a striking apparatus for generating a striking-in force in the driving direction of the screwable foundation, a rotation rate measurement device for determining the current rotation rate of the screwable foundation during its driving, furthermore a distance measurement device for determining the driving distance of the screwable foundation, and a regulating apparatus for regulating the rotation apparatus and striking apparatus and the switching on or off thereof. By means of the regulating apparatus, the rotation apparatus and the striking apparatus are able to be operated in alternation or at least temporarily simultaneously during the driving of the screwable foundation, so that by means of the regulating apparatus the amount of a defined slip value, determined from the current rotation rate, the pitch of the external helix and the driving distance of the screwable foundation, is not exceeded.

Preferably, the regulating apparatus acts on the rotation apparatus in a rotation rate reducing manner, and the striking apparatus is switched on when the screwable foundation impinges on a stone or hard ground, and the actual driving distance is less than a driving distance corresponding to the current rotation rate, until the amount of the defined slip value is reached.

Preferably, the striking apparatus is constructed as a device which emits ultra-high-frequency oscillations in the form of an acoustic source. Preferably, the high-frequency oscillations can also be generated by an apparatus which emits mechanical oscillations.

According to a further development of the apparatus, in addition a torque sensor is provided, by means of which the current torque can be measured, on the basis of which, on reaching a specified maximum permissible torque, the rotation apparatus is able to be switched off or down-regulated.

The apparatus preferably has at least one pair of contact surfaces, via which the torque is able to be transferred from the motor of the rotation apparatus to a drive shaft and to the screwable foundation. The pair of contact surfaces is arranged on a diameter which corresponds to at least twice, in particular five times the diameter of the drive shaft. The contact surfaces of the pair of contact surfaces are movable relative to one another, in particular in the direction of a rotation axis of the rotation apparatus.

BRIEF DESCRIPTION OF THE DRAWINGS

Further features and advantages of the invention will emerge from the following example embodiments in connection with the figures. There are shown here:

FIG. 2: the screwable foundation in a first position during screwing in, FIG. 3: the screwable foundation in a second position during screwing in.

DETAILED DESCRIPTION

Figure 1:
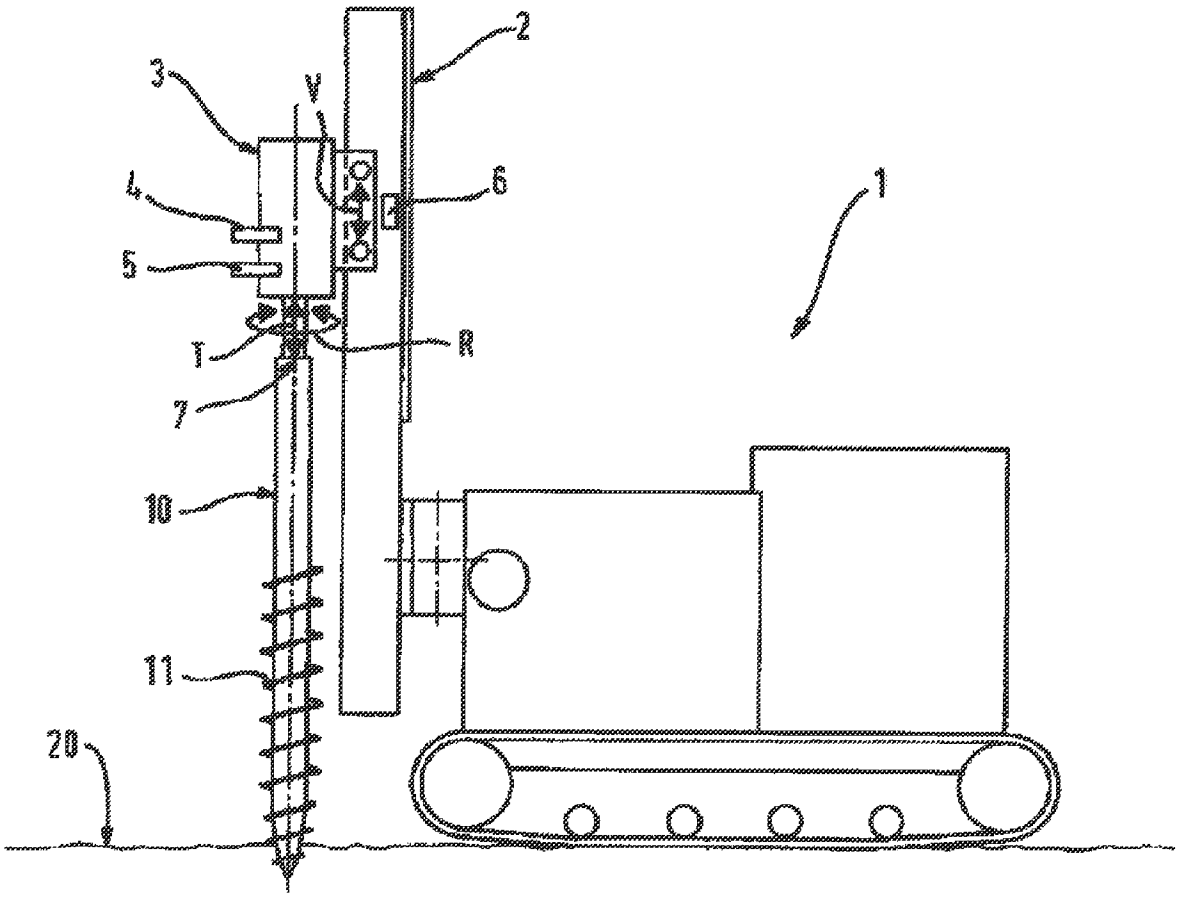
FIG. 1: an embodiment of a screwable foundation driving apparatus according to the invention.

FIG. 1 shows a driving apparatus 1 according to the invention for driving a screwable foundation 10 into the ground 20. The screwable foundation 10 has at least in partial regions a screw helix 11. The driving apparatus 1 has a carriage 2, in which a drive head 3 is displaceably arranged. Through the relative movement of the drive head 3 relative to the carriage 2, which generally takes place substantially in vertical direction, the advance V is provided for the driving of the screwable foundation 10. The advance V is able to be provided by the dead weight in particular of the drive head 3 or by an active drive with predetermined propelling force and/or propulsion speed. The drive head 3 has a coupling 7, which is able to be connected in a torsionally rigid manner with the screwable foundation 10. The coupling 7 is rotatable by the drive head 3 both in rotation direction R and also in translation direction T, in order to exert a percussion drilling process. On the drive head 3 or respectively on the driving apparatus 1 both a rotation rate sensor 4 and a torque sensor 5 for measuring the driving rotation rate or respectively the driving moment, and also a distance sensor 6 for determining the distance of advance and the speed of advance are provided.

Figure 2:
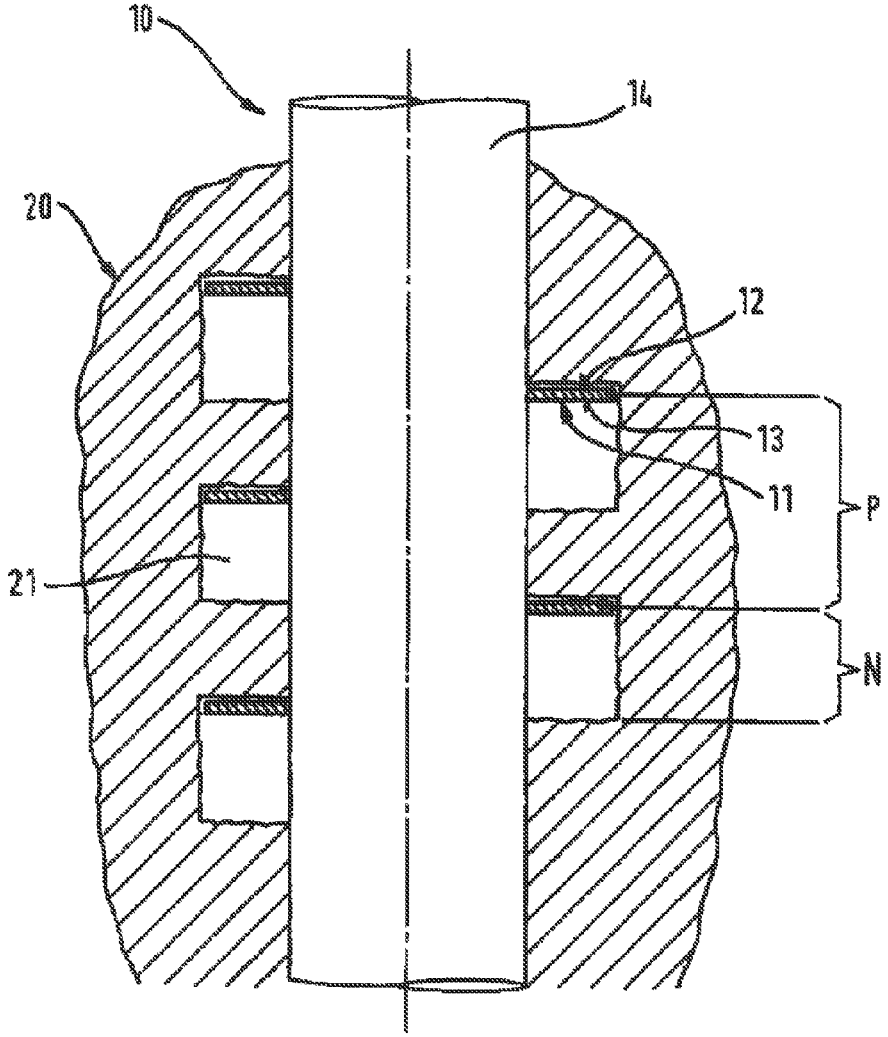

FIG. 2 shows a portion of the screwable foundation 10 in a first position during the driving into the ground 20. The screwable foundation has in this portion a thin-walled cylindrical sleeve 14 and the screw helix 11 arranged on its exterior. In an idealized screwing-in process, in which the speed of advance corresponds to the screwing-in speed of advance, i.e. screwing-in rotation rate n times the thread pitch p, the screw helix 11 cuts into the ground 20 such that both the upper and also the lower flank 12 or respectively 13 are in contact in the ground 20. In actual screwing-in processes, however, the speed of advance frequently does not coincide with the screwing-in speed of advance. In the case shown in FIG. 2, the speed of advance v is too little or respectively the rotation rate n is too great. This is also designated as a positive slip, so that the factor s for the slip is greater than 1. With a positive slip, a cavity 21 is produced beneath the lower flank 13 of the screwable foundation 10 during the driving. This occurs for example when the driving resistance, for example by a stone, is increased. The formation of such cavities 21 has a negative effect, however, on the stability (holding power) of the screwable foundation 10 in the ground 20. In the present application, the slip is defined as follows: $s=(n \cdot p)/v$.

The cavity 21 is produced in that the actual advance lags behind the ideal advance by the lag N.

Figure 3:
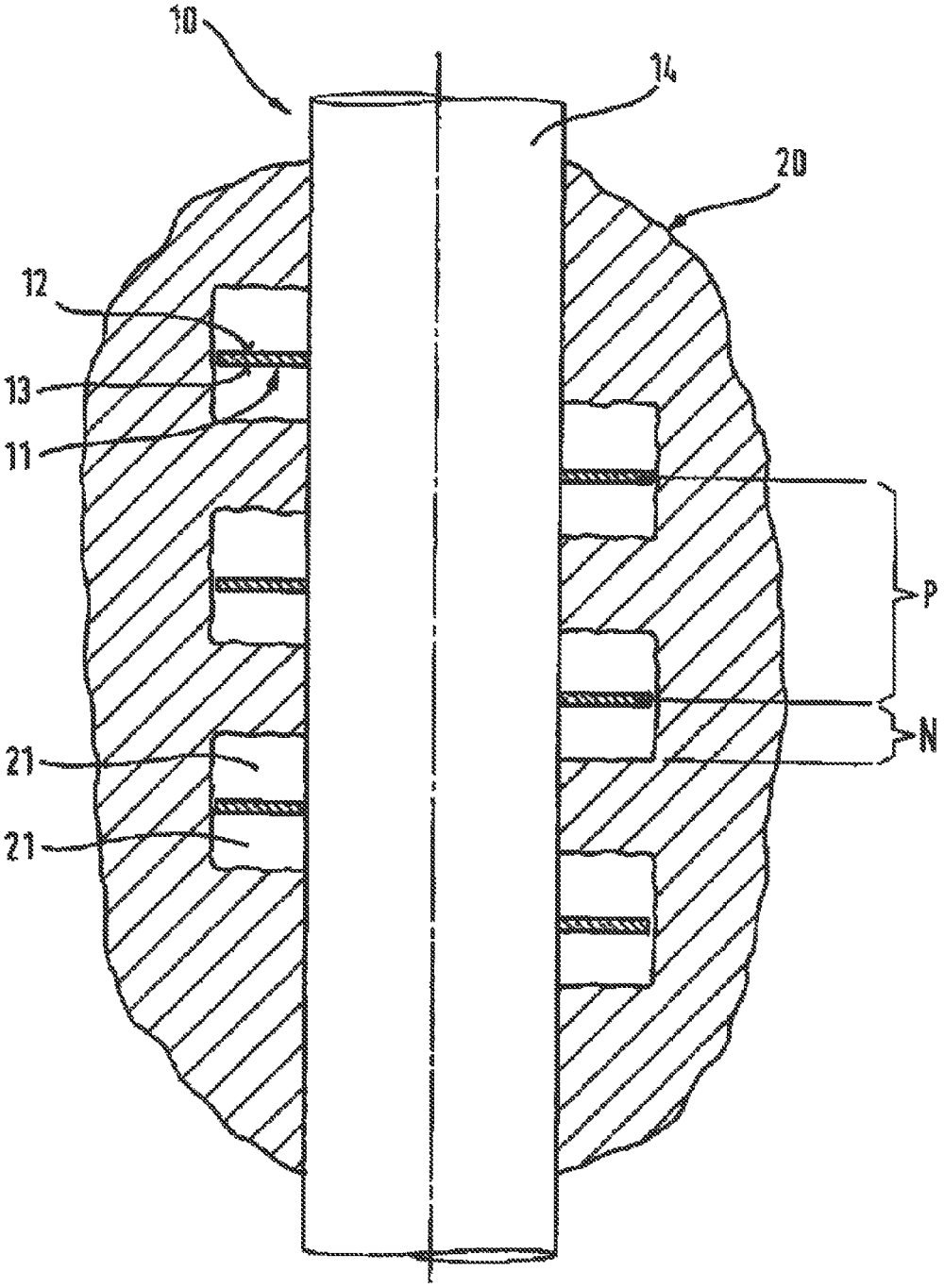

Through the method according to the invention, by the use of an in particular combined rotational- and striking- or respectively ramming movement, the lag N is to be reduced, as is shown in FIG. 3.

Figure 4:
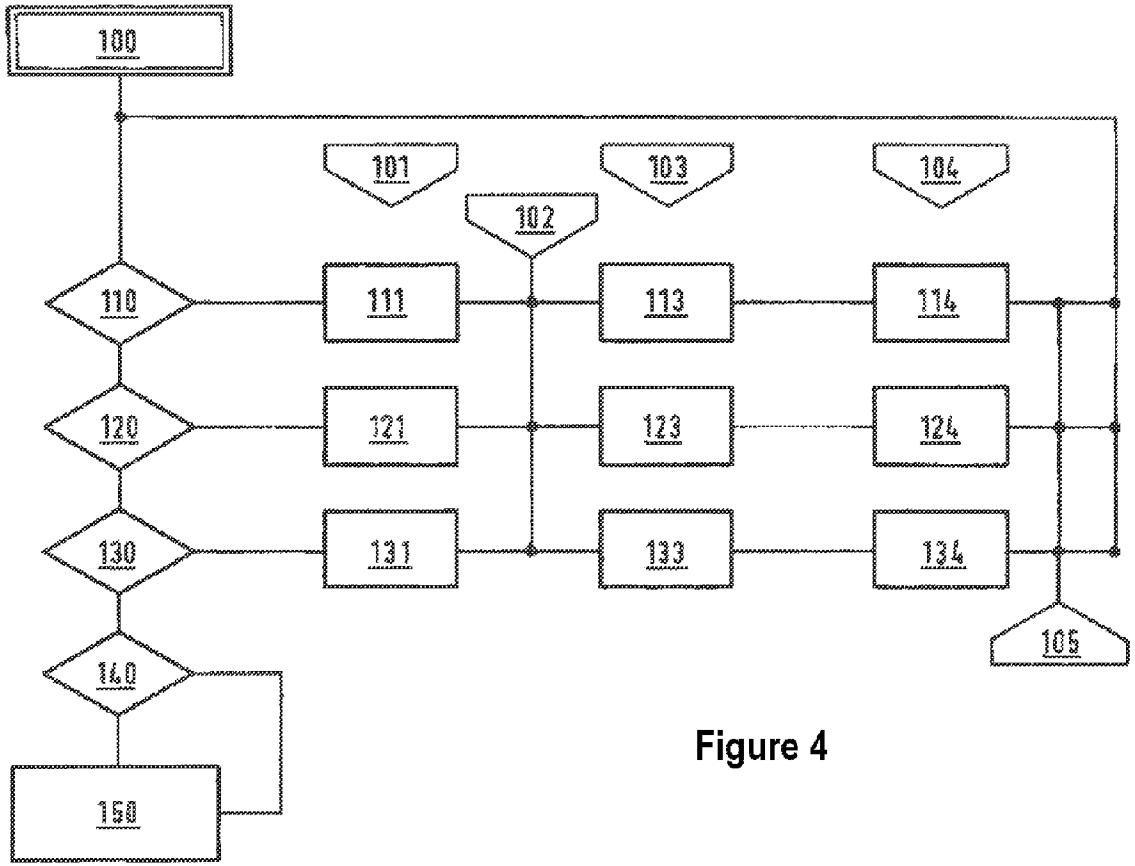
FIG. 4: a flow chart of a method according to the invention for driving a screwable foundation.

In FIG. 4 a flow chart is presented diagrammatically for a driving process according to the invention. The screwing-in process is started at step 100. After the start of the screwing-in process, the screwing-in process is monitored by means of the sensors for rotation rate, torque and advance (4, 5 and 6). Via these sensors in particular a stone detection 110, a thread protection 120 and a screwable foundation protection 130 are realized. The screwing-in depth is monitored via the advance sensor 6 as a switch-off condition for the driving process. When the screwing-in depth is reached, the driving process is terminated in step 150. The monitoring processes 110, 120 and 130 generally run parallel to one another. However, the individual types of regulation are also able to be implemented individually or in various combinations. For each of the monitoring operations there is a condition in column 101, by which the respective status is detected. In column 102, the striking apparatus or respectively the striking force is then switched on and the further driving is regulated according to column 103. On reaching an exit condition according to column 104, the striking mechanism is switched off according to column 105.

The stone detection 110 has as detection condition that an intrusion of the speed of advance takes place. In particular the current slip exceeds a predetermined threshold slip value, because for example the screwable foundation impinges onto a rock and the advance is abruptly reduced. By switching on the striking mechanism it is guaranteed that an advance also takes place in hard subsoil, for example in rock or stone. After switching on the striking mechanism, the rotation rate is regulated by means of the speed of advance and a positive slip, for example with $s=1.1$. Through the positive slip, after penetrating the rock, the advance is speedily accelerated again. The exceeding of a predetermined threshold rotation rate, for example 20 $min^{-1}$, applies as exit condition here. With the occurrence of the exit condition, the striking mechanism is switched off, and the rotation rate regulation is terminated.

For the thread protection 120, the detection 121 is determined by means of the covered advance distance and the distance ideally covered on the basis of the number of revolutions u and the thread pitch p. Consequently, the lag N applies as detection criterion. When the lag exceeds a predefined value, for example half a thread pitch p, then the striking mechanism switches on, and a rotation rate regulation also takes place. In the above-mentioned case, the slip s is regulated, however, to a value <1, for example 0.9, i.e. to negative slip. Thereby, the further destruction of the structure in the ground is counteracted, in particular that a conveying of earth to the surface by the screwable foundation 10 or respectively the screw helix 11 takes place. According to step 124, when the lag is reduced or falls below a predefined value, this applies as exit condition. On reaching the exit condition, the striking mechanism is switched off, and the rotation rate regulation is terminated.

A third type of regulation is represented by the screwable foundation protection according to 130. According to step 131, when a predefined maximum torque or respectively a limit torque is reached, this applies as detection criterion. For example, the torsional rigidity of the screwable foundation 10 or the nominal output of the drive head 3 can serve as limit torque. By activation of the striking mechanism, the screwing-in resistance of the screwable foundation 10 is reduced, by the ground being loosened. When the screwable foundation protection becomes active, the torque is regulated to the limit torque which is reduced if applicable by a safety factor, according to step 133. The falling below of the predetermined rotation rate threshold by a predefined value with maximum rotation rate serves here in particular as exit condition according to step 134. When, for example, the maximum torque lies at 3500 Nm, a value of 3000 Nm can function as limit torque for switching on. On occurrence of the exit condition according to step 134 the striking mechanism is switched off and the torque regulation according to step 133 is likewise terminated.

When in the three regulation types 110, 120 and 130 the exit condition occurs according to column 104, the program loop between steps 100 and the monitorings 110, 120 and 130 is returned, i.e. a monitoring still takes place according to steps 110, 120 and 130. Furthermore, the possibility exists that the monitorings 110, 120 and 130 are also active during a regulation according to column 103.

Figure 5:
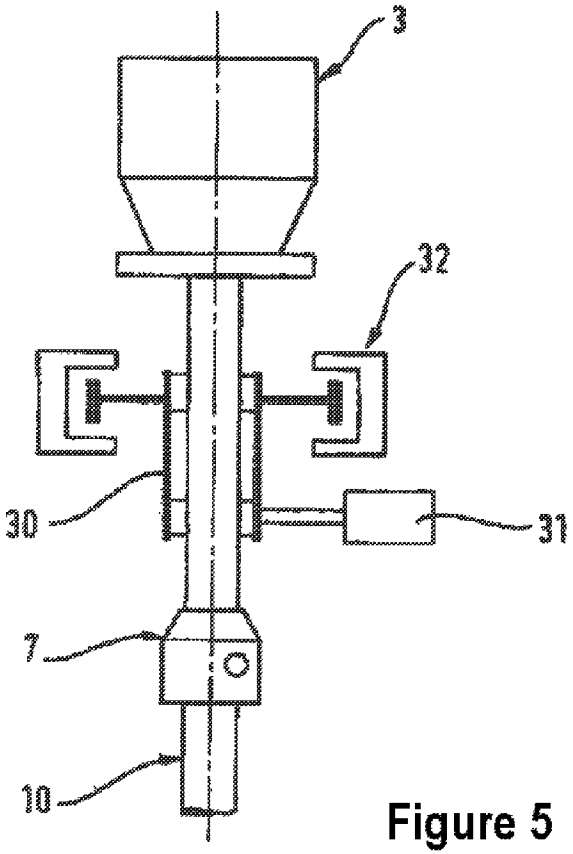
FIG. 5: a second embodiment of a screwable foundation driving apparatus according to the invention, FIG. 6*a, b*: a third embodiment of a screwable foundation driving apparatus according to the invention, and FIG. 7*a, b, c*: various developments of a screwable foundation in side view and bottom view, which is able to be driven into the ground by the method according to the invention or respectively by the apparatus according to the invention.

FIG. 5 shows a second embodiment of the driving apparatus 1 according to the invention, in particular of the drive of the driving apparatus 1 according to the invention, in which by means of an oscillation movement an oscillation is able to be introduced into the coupling 7. A sleeve 30 is rotatably mounted between drive head 3 and coupling 7. The sleeve 30 is arranged concentrically to the shaft. A mass 31 is arranged as unbalanced mass on the sleeve. Furthermore, the sleeve is able to be driven via a drive 32, for example an electric motor. By a setting of the mass 31 in rotation, an oscillation is exerted on the coupling 7 and therefore also on the screwable foundation 10. The rotation direction of the sleeve takes place here preferably in opposition to the rotation direction of the coupling. This apparatus can be arranged in addition to the percussion boring machine shown in example embodiment 1 on the driving machine 1 or only in combination with a boring machine. The introduction of oscillations, in particular vibrations, is advantageous in particular in the screwable foundation protection regulation or respectively in the overload protection according to step 130 in FIG. 4. However, it is also able to be used for example for the penetrating of stone in the stone detection according to step 110 in FIG. 4. The rotation axis of the mass 31 is alternatively also able to be arranged perpendicularly to the longitudinal axis of the screwable foundation. The rotation speed of the mass 31 is preferably between 1000 and 10000 $min^{-1}$.

Figure 6B:
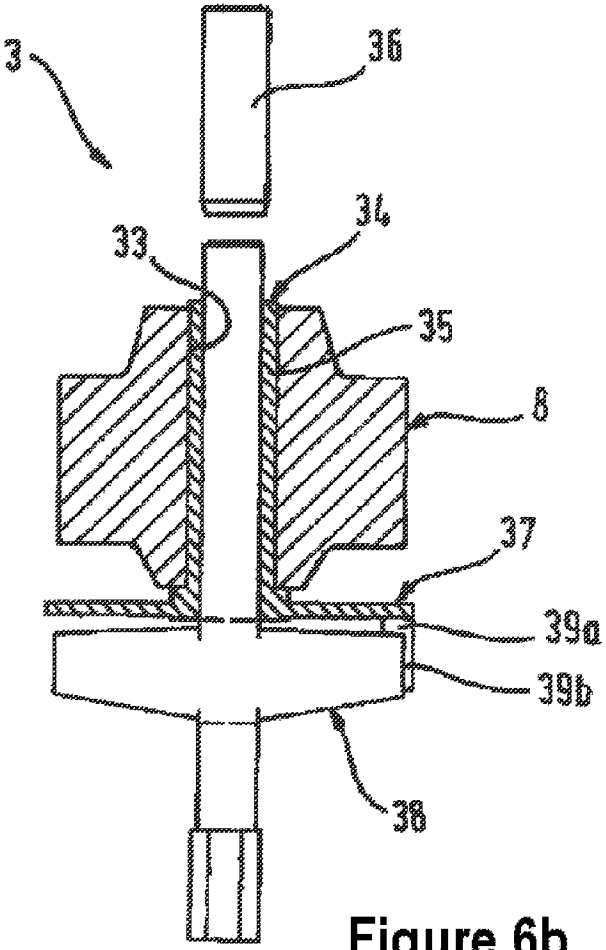
Figure 6A:
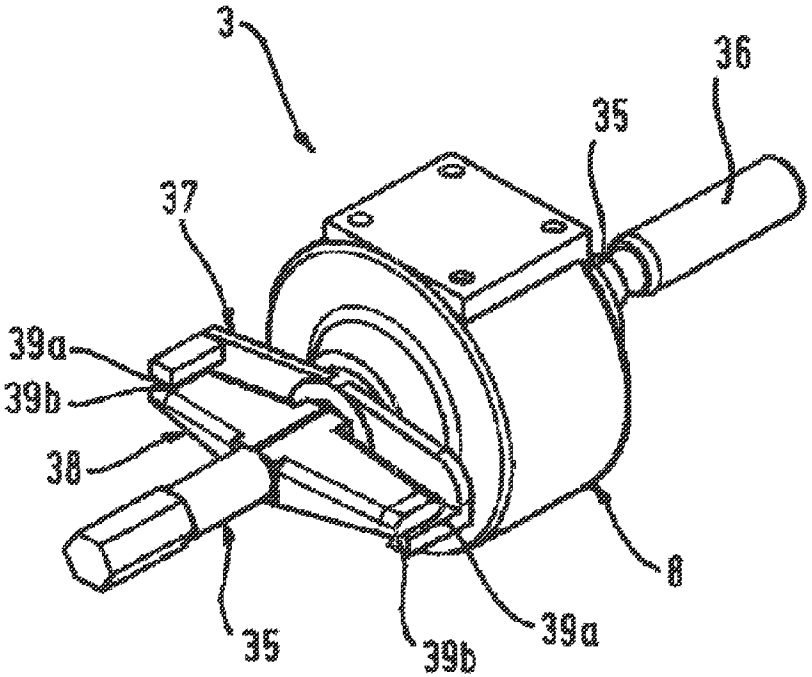

In FIGS. 6*a, b* a second embodiment of the driving apparatus 1 according to the invention, in particular of the drive of the driving apparatus 1 according to the invention, is shown. The motor 8 of the drive head 3 is constructed with a central feed-through 33, through which a hollow shaft 34 is guided and is driven by the motor 8. A drive shaft 35 is constructed concentrically to the hollow shaft 34 and is guided through the hollow shaft 34. On a first side of the motor 8 a striking pin 36 is arranged, via which striking energy is able to be introduced into the drive shaft 35. On the opposite second side of the motor 8, the hollow shaft 34 has two carriers 37, which form pairs of contact surfaces 39*a, b* with wings 38 arranged on the drive shaft. The torque of the motor 8 is transferred to the drive shaft 35 via the hollow shaft 34 and the pairs of contact surfaces 39*a, b*. The pairs of contact surfaces 39*a, b* are constructed here such that in the striking operation they permit a relative movement between hollow shaft 34 and drive shaft 35 in the direction of the longitudinal extent thereof. In addition, the pairs of contact surfaces 39*a, b* are arranged on a diameter which is distinctly greater than the diameter of the two shafts. The diameter on which the pairs of contact surfaces 39*a, b* are arranged corresponds approximately to 6 times the diameter of the drive shaft 35. Thereby, the surface pressure in the pairs of contact surfaces 39*a, b* is reduced, so that the friction and also the wear owing to the relative movement are reduced.

Figures 7A, 7B, 7C:
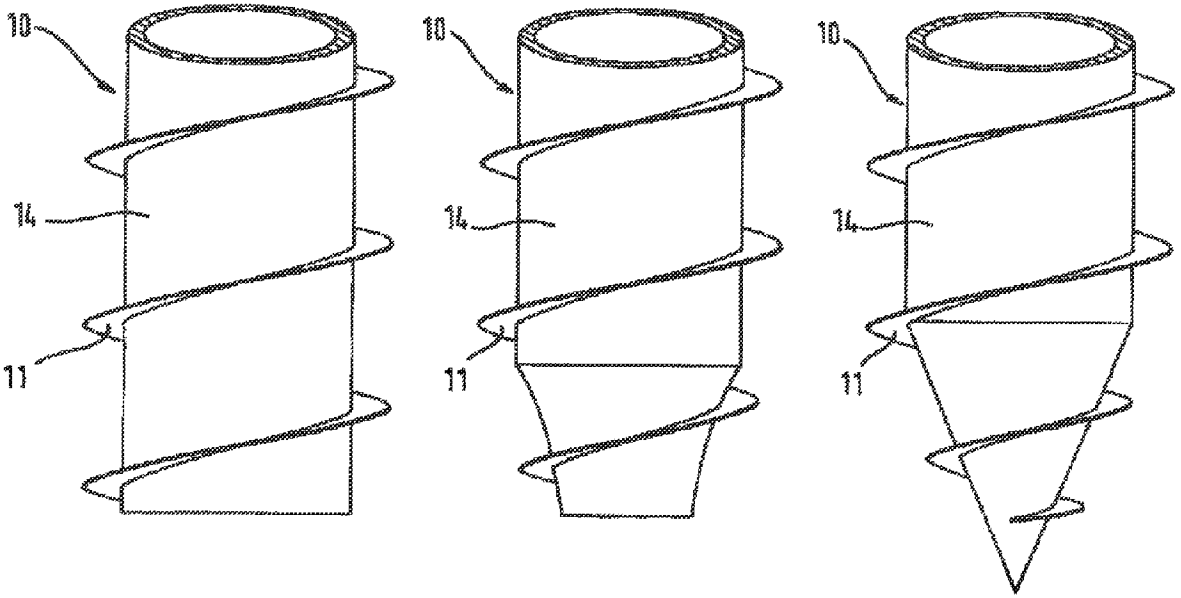

FIG. 7*a* shows a screwable foundation 10, which consists of a cylindrical, thin-walled sleeve 14. The screwable foundation 10 according to FIG. 7*b* has in the lower region a tapered portion and is open toward the bottom. The screwable foundation according to FIG. 7*c* has in the upper region a thin-walled cylindrical portion and in the lower region a cone-shaped portion, which terminates in a closed screwable foundation tip. In firm types of ground such as sandstone, preferably downwardly-open screwable foundations are used, because in contrast to closed screwable foundations, practically only the volume of the tube wall, but not the volume of the entire screwable foundation must displace. Owing to the ground which is firm in any case, a sufficient stability is guaranteed. In the screwable foundations which are shown, the screw helix 11 can be arranged over the entire length of the screwable foundation or only in partial regions.

The invention claimed is:

1. An apparatus for driving ground screw foundations into the ground, which have a sleeve body and on the exterior thereof an external helix with a thread-like pitch, which has a. a rotation apparatus for the screwing in of the ground screw foundation, a striking apparatus for generating a striking-in force in the driving direction of the ground screw foundation, b. at least one of the following devices from the group which comprises a rotation rate measurement device for determining the current rotation rate of the ground screw foundation during its driving, a distance measurement device for determining the driving distance of the ground screw foundation and a device for limiting the torque, and c. a regulating apparatus adapted for regulating the rotation apparatus and/or the striking apparatus and the switching on or off thereof with the aid of the values determined under b., by means of which the rotation apparatus and the striking apparatus are able to be operated in alternation or at least temporarily simultaneously during the driving;

in which the torque is transferable from the motor of the rotation apparatus via at least one pair of contact surfaces arranged on a predetermined diameter to a drive shaft and to the ground screw foundation, wherein the at least one pair of contact surfaces are movable relative to one another, and wherein the diameter in which the at least one pair of contact surfaces is arranged on is at least two times greater than the diameter of the drive shaft.

2. The apparatus as claimed in claim 1, in which the regulating apparatus defines the slip value from the current rotation rate, the pitch of the external helix and the driving distance of the ground screw foundation, which slip value is compared with a predefined amount of a slip value.

3. The apparatus as claimed in claim 1, in which the regulating apparatus acts on the rotation apparatus in a rotation rate reducing manner and switches on the striking apparatus, when the ground screw foundation impinges on a stone or on hard ground, and the actual driving distance is less than a driving distance corresponding to the current rotation rate, until the amount of a predetermined slip value is reached.

4. The apparatus as claimed in claim 1, in which the striking apparatus is constructed as an acoustic source emitting ultra-high-frequency oscillations having a frequency of up to 40 Hz.

5. The apparatus as claimed in claim 1, in which the striking apparatus is constructed as an apparatus emitting high-frequency mechanical oscillations having a frequency of up to 40 Hz.

6. The apparatus as claimed in claim 1, in which the rotation apparatus is able to be switched off or limits the torque on reaching the maximum torque on the basis of a signal provided by a torque sensor.

7. The apparatus as claimed in claim 1, wherein the diameter in which the at least one pair of contact surfaces is arranged on is at least five times greater than the diameter of the drive shaft.

8. The apparatus as claimed in claim 1, in which the pair of contact surfaces are movable relative to each other in a direction of a rotation axis of the rotation apparatus.

* * * * *